US008025712B2

(12) United States Patent
Dupuis et al.

(10) Patent No.: US 8,025,712 B2
(45) Date of Patent: Sep. 27, 2011

(54) IN-LINE SALT REFINING OF MOLTEN ALUMINIUM ALLOYS

(75) Inventors: Claude Dupuis, Jonquiere (CA); Carl Lakroni, Notre Dame de l'Île Perrot (CA); Peter Waite, Chicoutimi (CA)

(73) Assignee: Rio Tinto Alcan International Limited, Montreal (CA)

( * ) Notice: Subject to any disclaimer, the term of this patent is extended or adjusted under 35 U.S.C. 154(b) by 430 days.

(21) Appl. No.: 12/091,659

(22) PCT Filed: Oct. 25, 2006

(86) PCT No.: PCT/CA2006/001754

§ 371 (c)(1),
(2), (4) Date: Aug. 6, 2008

(87) PCT Pub. No.: WO2007/048240

PCT Pub. Date: May 3, 2007

(65) Prior Publication Data

US 2008/0307927 A1 Dec. 18, 2008

Related U.S. Application Data

(60) Provisional application No. 60/729,729, filed on Oct. 25, 2005.

(51) Int. Cl.
*C22B 21/06* (2006.01)
*C22B 9/10* (2006.01)

(52) U.S. Cl. ..... 75/680; 75/708; 266/235

(58) Field of Classification Search ..... 75/680, 75/708; 266/235

See application file for complete search history.

(56) References Cited

U.S. PATENT DOCUMENTS

| | | | | |
|---|---|---|---|---|
| 3,436,210 | A * | 4/1969 | Dewing et al. | 75/677 |
| 3,767,382 | A | 10/1973 | Bruno et al. | |
| 3,839,019 | A | 10/1974 | Bruno et al. | |
| 3,870,511 | A | 3/1975 | Szekely | |
| 4,138,425 | A | 2/1979 | Stary | |
| 5,527,381 | A | 6/1996 | Waite et al. | |
| 5,772,725 | A | 6/1998 | Eckert | |
| 6,375,712 | B1 * | 4/2002 | Forberg et al. | 75/680 |
| 6,508,977 | B2 * | 1/2003 | Eckert et al. | 266/235 |
| 6,602,318 | B2 | 8/2003 | Bilodeau et al. | |

FOREIGN PATENT DOCUMENTS

| | | | |
|---|---|---|---|
| CA | 227297 | | 11/1999 |
| EP | 395138 | | 10/1990 |
| EP | 1462530 | | 9/2004 |
| GB | 2205558 | A * | 12/1988 |
| JP | 63-183136 | | 8/1988 |
| WO | 0220860 | A | 3/2002 |

OTHER PUBLICATIONS

European Supplementary Search Report dated Apr. 7, 2010 (EP06790893.9).

Ohno, Yoshikazu, The latest molten metal refining processes in cast shop. Journal of Japan Institute of Light Metals No. 51 2001, p. 134-137. (English translation).

* cited by examiner

*Primary Examiner* — Roy King
*Assistant Examiner* — Jie Yang
(74) *Attorney, Agent, or Firm* — Banner & Witcoff, Ltd.

(57) ABSTRACT

The present invention describes an apparatus and a process for in-line substantially continuous degassing of aluminium and/or aluminium alloys, in absence of chlorine and through the injection of at least one metal halide salt that includes a halogen and water and an inert gas, in a transfer trough before casting.

18 Claims, 2 Drawing Sheets

IN-LINE SALT REFINING OF MOLTEN ALUMINIUM ALLOYS

BACKGROUND OF THE INVENTION

1. Technical Field

The invention concerns the continuous in-line refining of molten aluminium and aluminium alloys.

2. Description of the Prior Art

Molten metals such as aluminium and aluminium alloys which include both small amounts of dissolved, particulate and gaseous impurities are treated "in-line" in equipment that is placed in a metal carrying launder or trough prior to casting, continuous casting and other usages.

The aluminium metal flows into the trough at the inlet, through the trough and exits at the outlet, and this occurs in a substantially continuous manner. The trough is installed typically between a heated vessel (such as a casting furnace) and a casting machine. The treatment is intended to remove: i) dissolved hydrogen, ii) solid non-metallic particulates, for example alumina and magnesia, and iii) dissolved impurities, for example Na, Li and Ca. This refining treatment has traditionally been accomplished using chlorine gas or mixtures of chlorine gas with an inert gas such as argon. This refining process is commonly referred to as "metal degassing" although it will be appreciated that it may be used for more than just degassing of the metal, since it also removes other contaminants such as ii) and iii) discussed previously.

There is environmental pressure to eliminate chlorine in such applications and although use of argon alone can accomplish some of the treatment, it is inadequate for other uses and in particular for treating magnesium-containing aluminium alloys.

The use of chloride salts has been used in some furnace based or batch rather than continuous metal treatments. In particular magnesium chloride ($MgCl_2$), and mixtures of $MgCl_2$ with potassium chloride (KCl) have been considered as a possible substitute for chlorine gas. However, magnesium chloride is particularly hygroscopic, and therefore inevitably contains moisture and persistently absorbs moisture from ambient air. During treatment, this moisture reacts with molten aluminium to generate hydrogen that dissolves in the molten metal, and may lead to poor quality metal.

In furnace and crucible treatments the presence of moisture in the magnesium chloride can be accepted as these are generally for non-critical applications. However, use in in-line treatments where the metal is cast immediately cast after treatment, and for critical products where hydrogen porosity is unacceptable, magnesium chloride has not been usable.

Magnesium chloride ($MgCl_2$) has been used as a "cover flux" for in-line degassing treatment but this use compliments the use of in-line chlorine gas injection, and $MgCl_2$ is clearly not meant as a substitute for in-line chlorine gas of injection of the molten metal.

U.S. Pat. No. 3,767,382 discloses a continuous in-line metal treatment system comprising a dispersing and separation chamber separated by baffles that allow the separation of impurities. A rotary disperser in the dispersing chamber is used to break-up the molten metal and disperse a treatment gas comprising chlorine gas and an inert gas into the metal. The cover flux disclosed includes 80% $MgCl_2$ and moisture less than 0.1% by weight.

U.S. Pat. No. 4,138,245 discloses a means by which to remove sodium by introducing a chlorinating agent, which may be a mixture a chlorine gas and argon gas, introduced into a body of molten aluminium. Metal passes through a combination of filter-degasser bed coated with salt containing 85% $MgCl_2$. The salt is confined to the bed and reacts to reduce sodium levels in the metal.

U.S. Pat. No. 5,772,725 discloses a method for in-line treatment of molten metal that is said to be useable with salts as well as with gaseous fluxes, without any particulars as to how this is achieved. The invention discloses a disperser/agitator adapted to disperse gases into a metal bath where the agitator rotation is inverted regularly.

U.S. Pat. No. 6,602,318 discloses a treatment vessel, such as a ladle, that uses a mixture of $KCl/MgCl_2$ in a given weight ratio of 0.036 to remove calcium and particulates from the metal contained in the vessel. While $KCl/MgCl_2$ is fed by way of an injection tube below the level of the molten metal near a rotating high shear dispersing impeller, thus achieving quick dispersion of the $KCl/MgCl_2$.

EP-A-395 138 discloses a crucible treatment using various salts including salts containing up to 80% alkali metal and alkaline earth metal chlorides and including a disperser apparatus for handling such salts, which includes a co-injection of solids with an inert gas through a hollow shaft of the disperser below the level of the metal and at the level of the impeller.

EP-A-1 462 530 discloses an apparatus and method of treating molten metal in a crucible. The apparatus adds salt through a hollow shaft of a disperser. A pressurized inert gas transports the salt intermittently through the hollow shaft and into the metal in the crucible to the level of the impeller. The system may be used with a range of salt fluxes.

Therefore, all prior art either uses chlorine gas for refining the aluminium metal or is in a static crucible or in-line vessel which allows long residence times for the removal of impurities. Therefore there remains the problem of efficient in-line continuous refining of molten aluminium and aluminium alloys in troughs, without the use of chlorine gas.

SUMMARY OF THE INVENTION

The present invention discloses an apparatus and a refining process for in-line continuous refining of molten aluminium and aluminium alloys, with the use of a metal halide salt and an inert gas alone.

In accordance with one aspect of the present invention there is provided an in-line process for refining a molten aluminium or aluminium alloy flowing from an inlet to an outlet, the molten aluminium or aluminium alloy having a metal liquid level, the process comprising: adding an inert gas and at least one metal halide salt into the molten aluminium or aluminium, below the metal liquid level at an upstream disperser; dispersing the inert gas and the at least one metal halide salt into the flowing molten aluminium or aluminium alloy with the upstream disperser, adding only inert gas into the molten aluminium or aluminium alloy below the metal liquid level at a downstream disperser; and dispersing the inert gas into the flowing molten aluminium or aluminium alloy with the downstream disperser.

In accordance with another aspect of the present invention, there is provided an in-line process for refining a molten aluminium or aluminium alloy flowing through a trough from an inlet to an outlet, the molten aluminium or aluminium alloy having a metal liquid level, the process comprising: adding an inert gas and at least one metal halide salt into the molten aluminium or aluminium alloy flowing through the trough, below the metal liquid level at an upstream disperser; dispersing the inert gas and the at least one metal halide salt into the flowing molten aluminium or aluminium alloy with the upstream disperser, adding only inert gas into the molten aluminium or aluminium alloy flowing through the trough, below the metal liquid level at a downstream disperser; and dispersing the inert gas into the flowing molten aluminium or aluminium alloy with the downstream disperser.

In accordance with still another aspect of the present invention there is provided an apparatus for in-line refining molten aluminium or aluminium alloy in-line comprising; trough comprising, an upstream inlet and a downstream outlet, the trough allowing the molten aluminium or aluminium alloy to flow from the inlet to the outlet and the molten aluminium or aluminium allo definin a metal liquid level within the trough, wherein the trough has a depth of less than 400 mm and a width of less than 600 mm; at least one upstream disperser, at least one downstream disperser, each disperser comprising a rotatable shaft having a mounted end operatively connected to a drive means and a distal end opposite the mounted end, and an impeller fixed to the distal end, wherein the distal end and the impeller being adapted for immersion into the molten aluminium or aluminium alloy; a salt feeding system and a gas supply system, wherein the salt feeding system feeds an at least one metal halide salt into the trough below the metal liquid level proximal the at least one upstream disperser impeller and the gas supply system injects an inert gas into the trough below the metal liquid level proximal of the at least one of upstream disperser impeller and proximal the at least one of downstream disperser impeller, wherein the at least one upstream disperser and the at least one downstream disperser are operatively mounted in the trough.

BRIEF DESCRIPTION OF THE DRAWINGS

Further features and advantages of the present invention will become apparent from the following detailed description, taken in combination with the appended drawings, in which.

DETAILED DESCRIPTION OF THE PREFERRED EMBODIMENT

Figure 1:
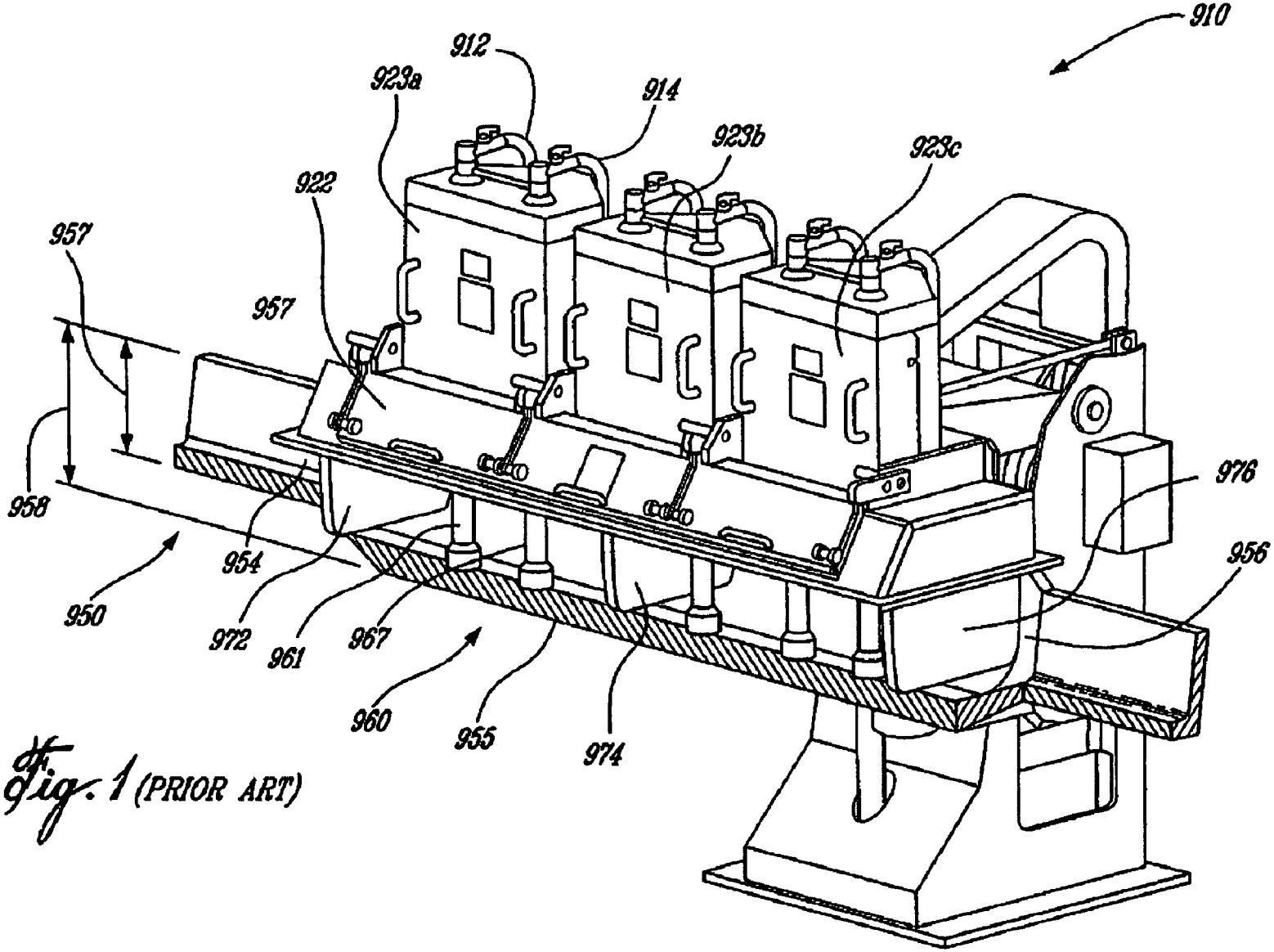
Fig. 1 (PRIOR ART)
FIG. 1. is a perspective view partly sectioned of an apparatus of the prior art, with part of the trough in which the apparatus is mounted removed displaying a plurality of dispersers in the trough.

FIG. 1 illustrates a prior art embodiment of apparatus which uses chlorine gas. The apparatus 910 illustrated includes a trough 950 (partially sectioned) and a series of dispersers 960 which in the represented embodiment includes six dispersers, one of which is hidden behind a baffle 974.

The trough 950, which can also be described as a metal transfer launder, includes an upstream inlet 954 and a downstream outlet 956, and the trough is adapted to allow molten aluminium and aluminium alloys to flow from the inlet 954 to the outlet 956. The trough 950 illustrated has a depth 957 upstream of trough inlet 954 and the downstream of the trough outlet 956. The central portion 955 of the trough 950 directly below the dispersers has a depth 958 and in this embodiment has a greater depth than the trough upstream of inlet 954 and downstream of the outlet 956. Although not illustrated the central portion 955 of the trough may also have a greater width than the width of the inlet 954 and the outlet 956.

The apparatus 910 further includes a series of six dispersers 960, two of which are identified by reference numbers 961 and 967. The series of dispersers are in a preferred embodiment installed in a straight line along the central line of the trough 971, each disperser roughly equidistant from an adjacent disperser along the central portion 955 of the trough and with their impellers adapted to rotate in the molten aluminium in the bottom of the trough 950. The dispersers are enclosed in the trough 950 by an enclosure 922. Above the series of dispersers is a drive means, preferably an electrical motor, compressed air motor or a series of belts or gears operatively connected to an electric motor. Three separate enclosures 923*a, b* and *c*, rise above enclosure 922, with each separate enclosure containing a drive means for two dispersers, i.e. in the case of enclosure 923*a*, the drive means for dispersers 961 and 967 is located therein.

Each disperser has a connection to a supply of gas. In FIG. 1 disperser 961 and 967 are connected to gas inlets 912 and 914 respectively. The gas passes through the rotating shafts of each disperser and is mixed with molten metal within internal passages in the impeller, and then the molten metal and gas mixture is ejected in a substantially horizontal manner from opening on the side of the impeller.

The illustrated enclosure 922. further includes a baffle 972 upstream of the first disperser and a baffle 976 downstream of the last disperser, and in the illustrated embodiment, an additional baffle 974 between the first three and last three dispersers. Additional baffles (not shown) between dispersers may also be used in some embodiments. The baffles allow metal to flow under and around while the baffles 972 and 976 in particular confine floating waste by-products (often referred to as dross) to the portion of trough between these baffles. This dross can be periodically removed, and the baffles prevent the dross from passing downstream and contaminating any filter, if used, or the ingot itself. The baffles 972 and 976 along with the enclosure 922 reduce the ingress of air into the area of trough containing the disperser and thereby reduce oxidation.

The disperser system 960 represented in FIG. 1, is similar to that described in U.S. Pat. No. 5,527,381 assigned to Alcan International Limited and herein incorporated by reference. The U.S. Pat. No. 5,527,381 is designed to pump the liquid, through the impeller without splashing or creating a vortex the liquid into which could entrain further gases, and/or impurities on the liquid surface.

The disperser system 960 of FIG. 1 operates by circulating or pumping the molten aluminium or aluminium alloy flow in the trough 950 from the inlet to the outlet with the injection and dispersion of chlorine and inert gas. The main impurities in the aluminium metal are (1) dissolved hydrogen gas; (2) particulates (oxides, carbides, borides and others) and dissolved alkali metals (such as Na, Li, Ca) which have detrimental effects on casting or subsequent product properties. The chlorine gas is effective in converting the alkali metals to salts which coalesce and rise to the surface assisted by the inert gas. The hydrogen preferentially diffuses into the inert gas bubbles and is removed and the particulate coalesces around the gas bubbles (assisted by any salts formed) and rises to the surface. The salts and particulates form dross or a waste by-product which is skimmed off periodically or captured in a downstream filter. The chlorine gas is added in excess of stoichiometric amounts and therefore this excess must be disposed of in an environmentally acceptable way.

Figure 2:
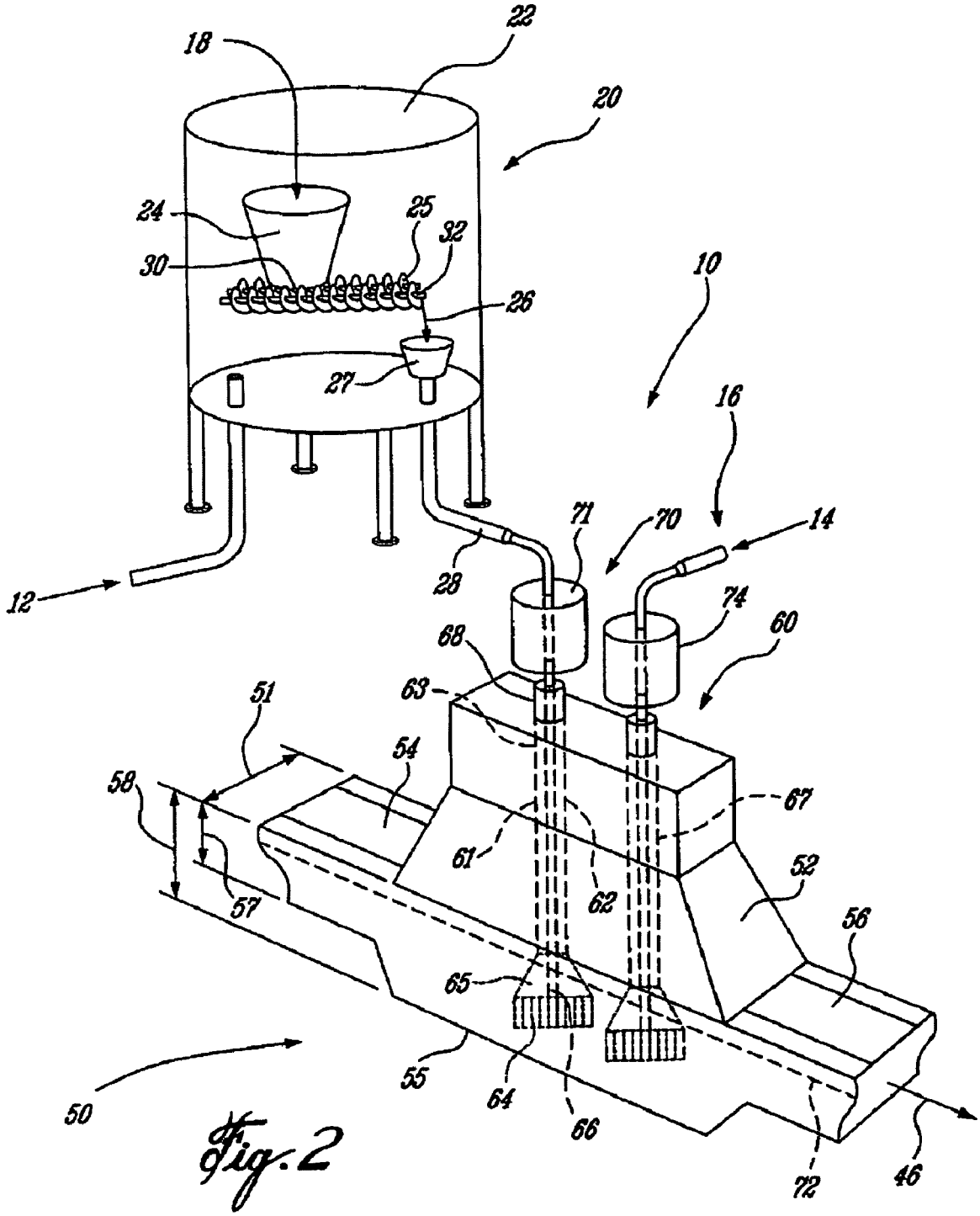
FIG. 2. is a schematic representation of an apparatus in accordance with one embodiment of the present invention, with a portion of the metal trough illustrated.

FIG. 2 illustrates a preferred embodiment of the present invention where apparatus 10 is used for in-line refining of molten aluminium and/or aluminium alloys without any chlorine gas. The in-line refining of the present invention will be understood by the skilled practitioner as a substantially continuous process where impurities in the aluminium or aluminium alloy are removed. These impurities as previously discussed are: dissolved gas such as hydrogen; particulates such as insoluble oxides; and dissolved alkali metals.

The refining apparatus 10 includes: a trough 50; a salt feeding system 20, a dispersing system 60 with at least one disperser 61, (FIG. 2 illustrates, two dispersers 61 and 67), and a gas supply system 16.

In-line refining is conducted, in a preferred embodiment, in a portion of a metallurgical trough 50 (which may be called a metal transfer launder) which is located between a casting (or metal holding) furnace and a casting machine. Such a metallurgical trough may have a slight slope from the casting furnace to the casting machine, and is adapted to cause molten metal to flow from the casting furnace to the casting machine. A portion 50 of such a metallurgical trough of the present invention is illustrated in FIG. 2 and has a molten metal upstream inlet 54 and downstream outlet 56 and through which molten metal flows in a substantially continuous manner. The locations of the inlet and outlet may each be defined at and have a baffle, similar to that of FIG. 1. The inlet 54 and the outlet 56 are respectively proximal to the most upstream disperser 61 and most downstream disperser 67.

Residence times of the molten metal between the inlet 54 and outlet 56 during in-line refining of the present invention vary and depend on the metal mass throughput, but are typically measured in tens of seconds. The portion 50 of the trough in which dispersers are located has little or no dead volume at the bottom of the trough, thus does not require a design including a specialized drain hole or a means of tipping the trough. The metallurgical trough including the portion 50 of the trough may be constructed in a refractory lined steel, or other suitable material of construction which would be well known to the skilled practitioner.

The central trough portion 55 is located at the dispersers and may have a depth 58 that is up to 50% greater than the depth 57 upstream on the inlet 54 and outlet 56. In a preferred embodiment, not illustrated in FIG. 2 the depth 58 is substantially the same as the depth 57. Similarly the width of the central trough portion 55 may be up to 50% wider than the width upstream of inlet 54 or downstream of outlet 56. Waste by-products (dross) comprising reaction products of the alkali and alkaline earth metals, solid particulates (oxides), and residual (or unreacted metal halide) salts, can be trapped behind baffles, if present at the inlet 54 and outlet 56 where they can be removed by the operator, or can be trapped in a filter located downstream of the outlet 56, as would be understood by the skilled practitioner. The residual metal halide salts are present due to dosing above a stoichiometric amount. Similarly the waste gas comprising a mixture of hydrogen and an inert gas can be removed by any conventional exhaust system. Due to the absence of chlorine gas, this waste gas does not need special handling. Thus the refined aluminium metal or aluminium alloy can be recovered or sent for further processing, and preferable towards a casting machine downstream of the outlet 56.

The trough of the present invention has in a preferred embodiment the following process and dimensional parameters:

a) typical metal flow rates up to about 1500 kg/min. However, generally the mass flow ratio is greater than about 100 kg/min. Clearly the skilled practitioner would understand that the trough 50 of the present invention may have mass flow rates below 100 kg/min when there is a no-flow condition and under other special circumstances;

b) salt is preferably added at a rate of at least 1 gm per 1000 Kg of metal. This is the minimum needed for effective removal of particulates. However, for effective removal of alkali metals, the salt should be added at a rate of at least 1 times stoichiometric requirements and more preferably at least 2 times stoichiometric requirements. The stoichiometric requirement is the amount of salt, based on its $MgCl_2$ content, required to exactly react and with all the Na. Li, Ca present and convert them to the corresponding chloride salts. However, salt additions of more than 10 times stoichiometric are not required, more preferable not more than 6 times stoichiometric. The low amount of salt addition for effective alkali removal results in limited water addition and hence hydrogen removal as effective as argon alone;

c) typical residence times of the metal between the inlet 54 and outlet 56, that is, in the trough under the influence of the dispersers is less than about 60 seconds and preferably in the range 25 to 35 seconds (regardless of the number of dispersers used); depth of the trough in the central trough portion 55 is typically less than about 400 mm and the width of the trough in the central trough portion is typically less than about 600 mm, more preferably the width may vary from 300 to 600 mm; and d) the typical spacing between dispersers is about 35 cm.

The salt feeding system 20, in a preferred embodiment is disposed above the dispersing system 60. The salt feeding system includes a salt hopper 24 into which a metal halide salt 18 is fed. In a preferred embodiment, the metal halide salt comprises $MgCl_2$ or a mixture of $MgCl_2$ and KCl and is sometimes called a flux. In a particularly preferred embodiment the salt is comprised of at least 20% by weight and even more preferably at least 50% by weight of $MgCl_2$ and 0.01% to 2.0% by weight of water. In some embodiment $MgCl_2$ may be replaced by $AlCl_3$.

The salt hopper 24 may be placed within a vessel 22, prior to transport by a feeder 25. The vessel 22 is slightly pressurized with an inert gas 12, from the gas supply system 16. In a preferred embodiment the inert gas is argon. The inert gas 12 enters the vessel 22 and may equally blanket the $MgCl_2$, or $MgCl_2$ and KCl mixture in the salt hopper 24, thus minimizing the absorption of additional humidity by the salt during storage, that would occur in ambient air.

The skilled practitioner would understand that the salt hopper 24 may be designed such that it replaces the pressurized vessel 22 and would therefore, be pressurized with inert gas and hermetically linked to the transport pipe 28 and the trough 50. The hopper 24 may also optionally include a vibrator or other mechanical means (not shown) to reduce or eliminate the bridging of the metal halide salt within the hopper 24.

The salt 18 from the salt hopper 24 enters the salt feeder 25, at an upstream entrance 30 of the feeder. The metal halide salt is typically a relative finely ground crystalline powder, which is typically free flowing and can be transported by mechanical and/or pneumatic means. The salt feeder 25, may be any one of a number of suitable feeders including but not limited to a double helical screw feeder, as illustrated in FIG. 2. The feeder should be capable of precise metering of the quantity of salt to be used. The metal halide salt 18 leaves the feeder 25 via a distal downstream exit 32, and is diagrammatically represented by arrow 26 in FIG. 2. The metal halide salt may enter a small silo 27 at the top of a transport pipe 28, or be directly and hermetically attached to transport pipe 28. The transport pipe 28, directs the metal halide salt 18 towards the metal trough 50. The transport of the metal halide salt 18 leaving the feeder 25 is assisted by pressurized inert gas 12, so that a flow of the salt and inert gas is established to transport the metal halide salt through the pipe 28 towards the trough 50.

The metal halide salt 18, from the transport pipe 28 may be added via hollow salt feeding tube (not illustrated) connected to the salt transport pipe 28 that is located adjacent the disperser 61. This salt feeding tube, allows the metal halide salt to be fed very close to and preferably directly underneath the disperser impeller 64 into the molten aluminium or aluminium alloy in the bottom of the trough 50. As previously mentioned in a preferred embodiment the salt and inert gas may both be fed through the transport pipe 28 and salt feeding tube of the salt feeding system 20. The inert gas assists the passage of the metal halide salt, and both are expelled in a simultaneous or substantially simultaneous manner at a point near the impeller 64, and preferably underneath the impeller, into the molten aluminium or aluminium alloy.

In a particularly preferred embodiment illustrated in FIG. 2 the metal halide salt is fed through a rotating shaft 62 of a disperser 61. The shaft 62 includes a longitudinal central bore 66 extending through the rotating shaft 62 from a mounted end 63 of the shaft 62 to the distal or end immersed in molten aluminium 65. The mounted end 63 is also operatively connected to a rotary seal 68 and a motor 70. In one embodiment the motor 70 is located outside the enclosure 52, but may also be found within the enclosure. The rotary seal 68, allows the shaft 62 to rotate while maintaining a seal and an inert atmosphere within a trough enclosure 52. The rotary seal 68 may also be the point through which the inert gas 12 and metal halide salt 26 pass via the bore 66 into the molten metal. The motors (71, 74) are coupled to the top ends of the shafts, but they have hollow through shafts so than gas/salt can be fed though the hollow shaft at the top of the motor and pass to the hollow shaft of the disperser. A rotary seal is provided to the shaft at the top of the motor. The distal end 65 of the disperser 61 has a high shear impeller 64 attached and is the location of the outlet of the bore 66 from which the inert gas 12 and the metal halide salt is fed into the molten metal. The dispersers are typically located centrally with respect to the trough width 51, and the rotation of the disperser is such that the molten aluminium.

The disperser system 60, in the embodiment illustrated in FIG. 2 includes two dispersers 61 and 67, that disperse the metal halide salt and inert gas into the flowing molten metal in the bottom of the trough 50, the metal liquid level 72 is illustrated. The disperser 61 includes a rotating shaft 62 and a dispersing impeller 64. The disperser system represented is similar to that described in U.S. Pat. No. 5,527,381 but adapted to allow passage of the metal halide salt through the central bore 66 of the disperser shaft 62.

FIG. 2 further illustrates that all the dispersers need not include a halide salt addition, as with disperser 67 where only inert gas 14 is injected. In the case where there are a plurality of dispersers the trough 50 may include baffles (not shown) and similar to that described in FIG. 1. In another preferred embodiment consecutive dispersers rotate in opposite directions, or sequentially clockwise then counter clockwise and so forth.

In yet another alternative embodiment, where there are a plurality of dispersers, inert gas and salt is added at least at the most upstream of the dispersers, and inert gas alone is added at least at the most downstream of the dispersers. In this embodiment, the salt is highly effective at particle and alkali metal removal so that it is required only in the upstream dispersers and the extra hydrogen that may be generated by the moisture in such amounts of salt are removed by the inert gas in the downstream dispersers.

In another alternative embodiment, more than one disperser may be fed the halide salt and the delivery rates of the salt may be made to vary from one disperser to the next. In a preferred embodiment the disperser furthest upstream would have the largest feed rate of salt, while the dispersers downstream would have sequentially lower feed rates.

The dispersing system 60 may also have a plurality of dispersers 61 through which or near which the inert gas and metal halide salt is injected into the molten liquid. As many as 6, 8 or more dispersers may be installed, with a preferred embodiment having from 4 to 6 dispersers.

The gas supply system 16 (not illustrated) comprises: a source of inert gas from a cylinder of compressed gas or a gas in liquid phase; a system to regulate the pressure of the inert gas; a manifold distributing the inert gas into small tube connections which can then be routed to where they are needed, such as illustrated in FIG. 2, by reference numbers 12 and 14. The gas supply system 16 may comprise inert gases alone or in combination, these gases include helium, neon and argon, with argon being the preferred embodiment and it is understood that the gas supply system 16 does not contain reactive gases, and particularly does not contain chlorine gas.

EXAMPLE 1

Aluminium alloy type AA1100 was prepared and delivered to an apparatus similar to that illustrated in FIG. 2 however including four dispersers. A halide salt and argon mixture was delivered via the first (most upstream) disperser and argon alone injected into the three remaining dispersers. Argon was delivered at a total rate of 160 standard liters per minute distributed across the four dispersers. The rate of particle removal, the hydrogen removal and percent alkali metal removal as well as the results from a similar degasser using a chlorine/argon mix without salt are presented in Table 1.

TABLE 1

| *Salt Blend | % water | kg salt/ 1000 kg metal | $H_2$ removal | Ca removal | Na removal | parti-culate removal |
|---|---|---|---|---|---|---|
| 60/40 | 0.17% | 0.078 | 61.50% | 66.70% | 77.70% | 100.00% |
| 60/40cr | 0.21% | 0.078 | 57.10% | 62.50% | 80.30% | 95.00% |
| 75/25 | 0.30% | 0.021 to 0.142 | 63.92% | 75.80% | 91.92% | 100.00% |
| 90/10 | 0.31% | 0.056 to 0.146 | 60.51% | 69.15% | 86.11% | 97.50% |
| no salt | — | — | 50 to 60% | 45 to 55% | 45 to 55% | 30 to 70% |

*Salt Blend values are given in terms of a weight ratio of $MgCl_2$/KCl, while "cr" represents "crushed" $MgCl_2$/KCl.

The results indicate a high level of particulate removal. It is believed that the invention works by ensuring that by excellent dispersion of the halide salt in the trough particulate removal can be achieved with low halide salt levels. Furthermore, this may mean that hydrogen generation from entrained moisture is less than previously believed and removal of any extra generated hydrogen appears plausible. Furthermore the salt need only be added through or near the disperser furthest upstream while subsequent dispersers downstream thereof may in fact remove entrained hydrogen.

EXAMPLE 2

An aluminium alloy type AA6063 was prepared and delivered to an apparatus similar to that illustrated in FIG. 2 however including six dispersers. A halide salt and argon mixture was delivered via the first (most upstream) disperser and argon alone injected into the five remaining dispersers. Argon was delivered at a total rate of 260 standard liters per minute distributed across the six dispersers. Results are shown in Table 2.

TABLE 2

| Salt Blend ($MgCl_2$/KCl weight percent) | % water | kg salt/1000 Kg metal | $H_2$ out | Ca removal* | Na removal* | Particulate removal |
|---|---|---|---|---|---|---|
| 75/25 | 0.30% | 0.009 to 0.052 | 0.11 ml/100 g | 36.3% | 69.1% | 69.4% |
| Argon only | — | — | 0.11 ml/100 g | — | — | 8.3% |

*Only results obtained for trials with alkali concentration greater then 1 ppm are considered.

In this example the salt was added at a stoichiometric ratio of 1 to 4 times stoichiometric indicating that alkali removal is effective at a relatively small stoichiometric excess. The effect of salt addition on particulate removal compared to argon is clearly shown.

EXAMPLE 3

An aluminium alloy type AA5005 was prepared and delivered to an apparatus similar to that illustrated in FIG. 2 however including six dispersers. A halide salt and argon mixture was delivered via the first (most upstream) disperser and argon alone injected into the five remaining dispersers. Argon was delivered at a total rate of 270standard liters per minute distributed across the six dispersers. Results are shown in Table 3.

TABLE 3

| Salt Blend ($MgCl_2$/KCl weight percent) | % water | kg salt/1000 Kg metal | $H_2$ out | Ca removal* | Na removal* | Particulate removal |
|---|---|---|---|---|---|---|
| 75/25 | 0.30% | 0.005 to 0.027 | 0.15 ml/100 g | 10.0% | 29.6% | 71.7% |

*Only results obtained for trials with alkali concentration greater then 1 ppm are considered.

The salt addition in this example was at a rate corresponding to only 0.1 to 0.5 times stoichiometric requirements for alkali metal removal and the removal was correspondingly low. However the particulate removal was still high, indicating that particulate removal is efficient even at low salt feed rates.

EXAMPLE 4

Aluminium alloy type AA1200 was prepared and delivered to an apparatus similar to that illustrated in FIG. 2 however including six dispersers. A halide salt and argon mixture was delivered via the first (most upstream) disperser and argon alone injected into the five remaining dispersers. Argon was delivered at a total rate of 270 standard liters per minute distributed across the six dispersers. Results are shown in Table 4.

TABLE 4

| Salt Blend ($MgCl_2$/KCl weight percent) | % water | kg salt/1000 Kg metal | $H_2$ out | Ca removal* | Na removal* | Particulate removal |
|---|---|---|---|---|---|---|
| 60/40 | 0.56% | 0.027 | 0.10 ml/100 g | — | 71.1% | 84.7% |
| 75/25 | 0.30% | 0.021 to 0.030 | 0.12 ml/100 g | — | 49.5% | 61.7% |
| $Cl_2$ | — | — | 0.10 ml/100 g | 15.4% | 64.8% | 61.8% |

*Only results obtained for trials with alkali concentration greater then 1 ppm are considered.

The salt addition in this example was at a rate corresponding to only 2 to 6 the stoichiometric requirements for alkali metal removal indicating that alkali removal is effective at a relatively small stoichiometric excess.

The embodiment(s) of the invention described above is(are) intended to be exemplary only. The scope of the invention is therefore intended to be limited solely by the scope of the appended claims.

The invention claimed is:

1. An in-line process for refining a molten aluminium or aluminium alloy flowing from an inlet to an outlet, the molten aluminium or aluminium alloy having a metal liquid level, the process comprising:

adding an inert gas and at least one metal halide salt into the molten aluminium or aluminium alloy, below the metal liquid level at an upstream disperser;

dispersing the inert gas and the at least one metal halide salt into the flowing molten aluminium or aluminium alloy with the upstream disperser, adding only inert gas into the molten aluminium or aluminium alloy below the metal liquid level at a downstream disperser; and dispersing the inert gas into the flowin molten aluminium or aluminium alloy with the downstream disperser.

2. An in-line process for refining a molten aluminium or aluminium alloy flowing through a trough from an inlet to an outlet, the molten aluminium or aluminium alloy having a metal liquid level, the process comprising:

adding an inert gas and at least one metal halide salt into the molten aluminium or aluminium alloy flowing through the trough, below the metal liquid level at an upstream disperser;

dispersing the inert gas and the at least one metal halide salt into the flowing molten aluminium or aluminium alloy with the upstream disperser, adding only inert gas into the molten aluminium or aluminium alloy flowing through the trough, below the metal liquid level at a downstream disperser; and dispersing the inert gas into the flowing molten aluminium or aluminium alloy with the downstream disperser.

3. The process of claim 2, comprising:

removing waste by-products from the molten aluminium or aluminium alloy in the trough or downstream of the outlet, and withdrawing a refined aluminium or aluminium alloy.

4. The process of claim 3, comprising:

casting the refined aluminium or aluminium alloy.

5. The process of claim 3, wherein the waste by-products are a mixture of reaction products of impurities in the molten aluminium or aluminium alloy with at least one of the metal halide salt, solid particles and residual salts.

6. The process of claim 5, wherein the solid particles are oxides.

7. The process of claim 2, wherein a waste gas from the molten aluminium or aluminium alloy is withdrawn by any conventional exhaust system.

8. The process of claim 2, wherein the at least one metal halide salt comprises $MgCl_2$.

9. The process of claim 2, wherein the at least one metal halide salt is at least 20% by weight of $MgCl_2$ and 0.01% to 2.0% by weight of water.

10. The process of claim 9, wherein the at least one metal halide salt comprises at least 50% by weight $MgCl_2$.

11. The process of claim 2, wherein the at least one metal halide salt comprises $MgCl_2$ and KCl.

12. The process of claim 2, wherein the at least one metal halide salt is added at rate of 0.01 to 0.20 kg per ton of the molten aluminium or aluminium alloy.

13. The process of claim 2, wherein the inert gas is selected from the group consisting of helium, neon, and argon.

14. The process of claim 13, wherein the inert gas is argon.

15. The process of claim 2, wherein the at least one halide salt and inert gas are dispersed at a disperser furthest upstream and only inert gas is dispersed at the remaining dispersers.

16. The process of claim 2, wherein the at least one metal halide salt comprises 0.01 to 2.0% by weight of water.

17. The process of claim 2, wherein the molten aluminum or aluminum alloy flowing from the inlet to the outlet of the trough has a residence time of about 60 seconds.

18. The process of claim 2, wherein the molten aluminum or aluminum alloy flowing from the inlet to the outlet of the trough has a residence time in the range of 25 to 35seconds.

* * * * *